United States Patent [19]

Burzen et al.

[11] 4,280,247

[45] Jul. 28, 1981

[54] LUGGAGE CASE HANDLE ASSEMBLY

[75] Inventors: Don N. Burzen, Groton, Mass.; David E. Workman, Evergreen, Colo.; Robert L. Bromley, Aurora, Colo.; Daniel G. Elles, Kittredge, Colo.; James E. Wilkuski, Evergreen, Colo.

[73] Assignee: Samsonite Corporation, Denver, Colo.

[21] Appl. No.: 56,207

[22] Filed: Jul. 10, 1979

[51] Int. Cl.[3] ..... A47B 95/02; A47J 45/00; B65D 25/28; E05B 1/00

[52] U.S. Cl. ..... 16/112; 190/57

[58] Field of Search ..... 16/111, 112, DIG. 12, 16/DIG. 18, DIG. 19, DIG. 24; 190/39, 57, 58 R; 220/94 R

[56] References Cited

U.S. PATENT DOCUMENTS

| | | | |
|---|---|---|---|
| 2,254,506 | 9/1941 | Wheary | 190/58 R |
| 3,103,268 | 9/1963 | Atkinson | 190/58 R |
| 3,657,764 | 4/1972 | Relly | 16/112 |

FOREIGN PATENT DOCUMENTS

| | | | |
|---|---|---|---|
| 1457239 | 11/1968 | Fed. Rep. of Germany | 190/58 R |
| 377963 | 8/1932 | United Kingdom | 190/57 |

*Primary Examiner*—Wayne L. Shedd
*Attorney, Agent, or Firm*—George J. Netter

[57] ABSTRACT

This invention is a handle assembly for luggage. It includes an elongated, hollow, complaint handgrip portion having a pair of parallel grooves on its upper surface. A rigid end member is received in each end of the hollow handgrip and extends away from the same side of the handgrip at a divergent angle. Openings in the distal ends of the rigid end members engage co-operating means on the luggage case. A metal U-shaped member engages the two inserted rigid end members and the parallel grooves to hold the handle parts in proper assembled relation.

6 Claims, 7 Drawing Figures

LUGGAGE CASE HANDLE ASSEMBLY

The present invention relates generally to a handle assembly, and, more particularly, to an improved handle assembly for use on a luggage case.

SUMMARY OF THE INVENTION

The handle assembly of this invention includes an elongated compliant grip having a longitudinally extending opening passing completely therethrough and a pair of parallel grooves on an upper surface, one adjacent each side. First and second hard rigid end members are respectively received in the end openings of the compliant grip and extend angularly away from the same side of the grip. A metal half-shell frame which is generally U-shaped in cross-section, has its side edges received in the grooves on the grip and in similarly dimensioned grooves in the first and second rigid end members. The frame is otherwise fittingly received about and in covering relationship to both the grip and end members to secure them together as a unit.

Each end of the metal frame has a keyed opening within which is rotatably received a stub shaft extending from a mounting stanchion. The stanchions are affixed to the top surface of the luggage case cover.

DESCRIPTION OF A PREFERRED EMBODIMENT

Figure 1:
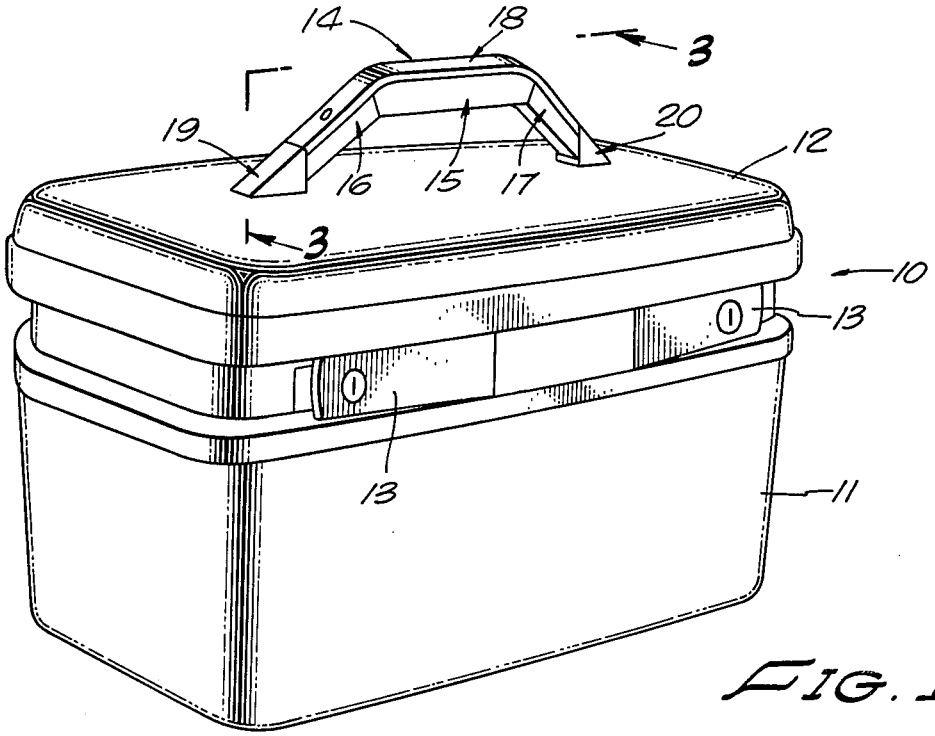
FIG. 1 is a perspective view of a luggage case showing the handle assembly of this invention mounted thereon.

With reference now to FIG. 1, a luggage case of the variety frequently referred to as a train case, is identified generally as at 10, and includes a lower container shell 11 releasably joined to a cover 12 by latches 13, for example. The handle assembly 14 to be described is secured to the top lid of the cover 12 and is seen to have a generally trapezoidal appearance with the handle gripping portion being straight-line and parallel to the luggage case cover, and with two end portions extending angularly downwardly from the gripping portion for rotative securement to the cover.

Figure 2:
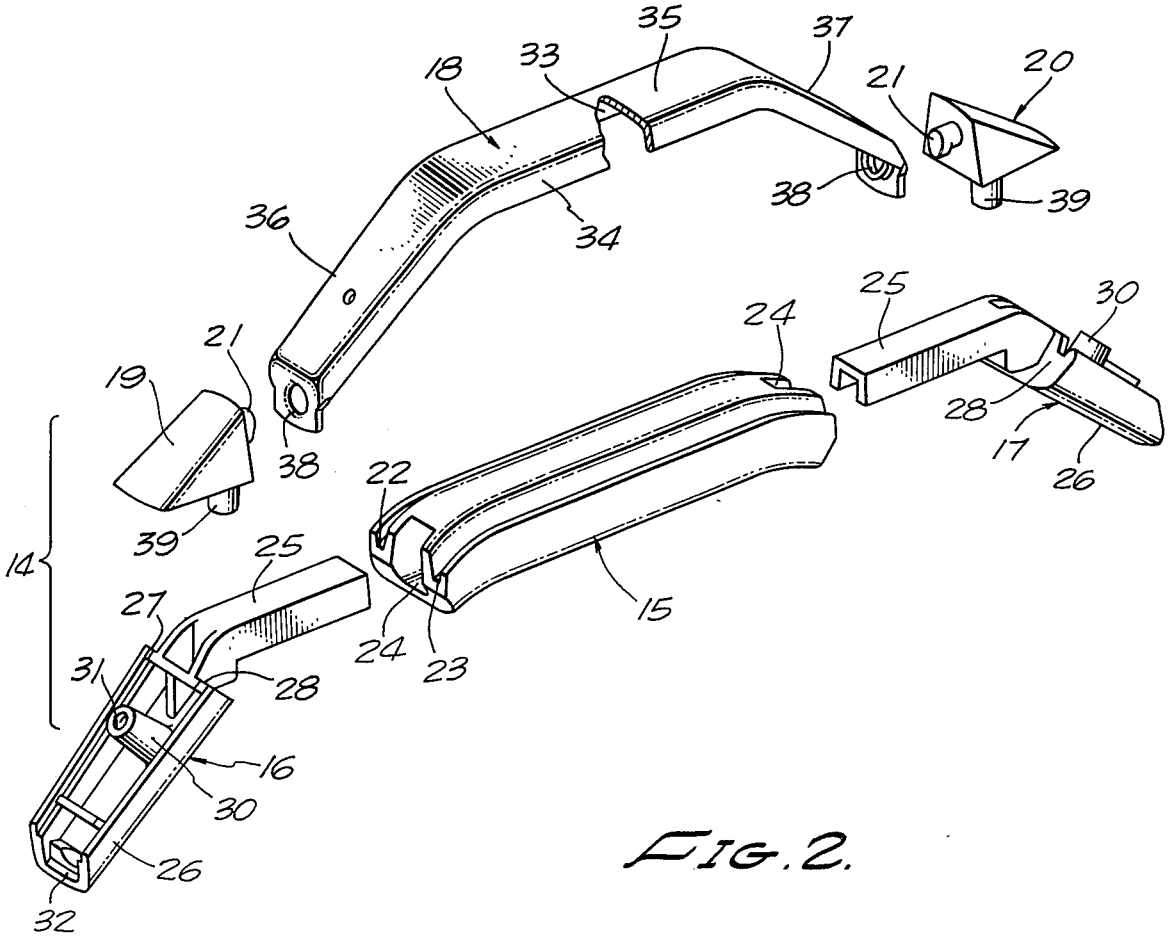
FIG. 2 is an exploded view of the various parts of the described handle assembly.

Turning now to FIG. 2, the handle assembly 14 is seen to include in its various components an elongated gripping member 15, first and second end parts 16 and 17 for sliding receipt within the ends of the gripping portion, and a half-shell frame 18 received about the gripping member and two end parts unitarily securing them together. First and second stanchions 19 and 20 are affixed to the cover 12 of the case and each includes a stub shaft 21 which are received through openings in the frame 18 for rotatably mounting the handle assembly to the cover 12.

Figure 6:
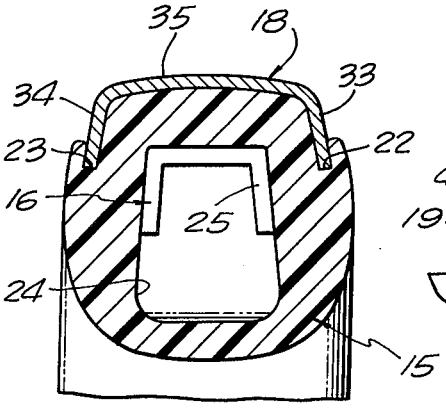
FIG. 6 is a sectional, end elevational view along the line 6—6 of FIG. 3.

For the ensuing description of the gripping member 15 reference is made simultaneously to FIGS. 2 and 6. The member 15 is of a total length slightly greater than that necessary to enable grasping with the four fingers of one hand. It is substantially rectangular in cross-section with the lower corners rounded off making them more comfortable to the grip. A pair of grooves 22 and 23 extend longitudinally along the upper surface of the member and lying closely adjacent the outer sides thereof. The central portion of the member between the grooves extends above the grooves and outer edge portions of the member. An opening 24 extends completely throughout the body of the gripping member 15 and in cross section is generally trapezoidal with the narrow width toward the bottom. The bottom wall surface of the member 15 is a straight line, as can be seen best in FIG. 3 whereas the top wall surface is formed immediately adjacent each end to taper downwardly a slight extent for a purpose to be described. Preferably the gripping member is molded from flexible rubber or pliant synthetic plastic material since this will add to the comfort of the user by being soft and pliable to the grip.

Figure 3:
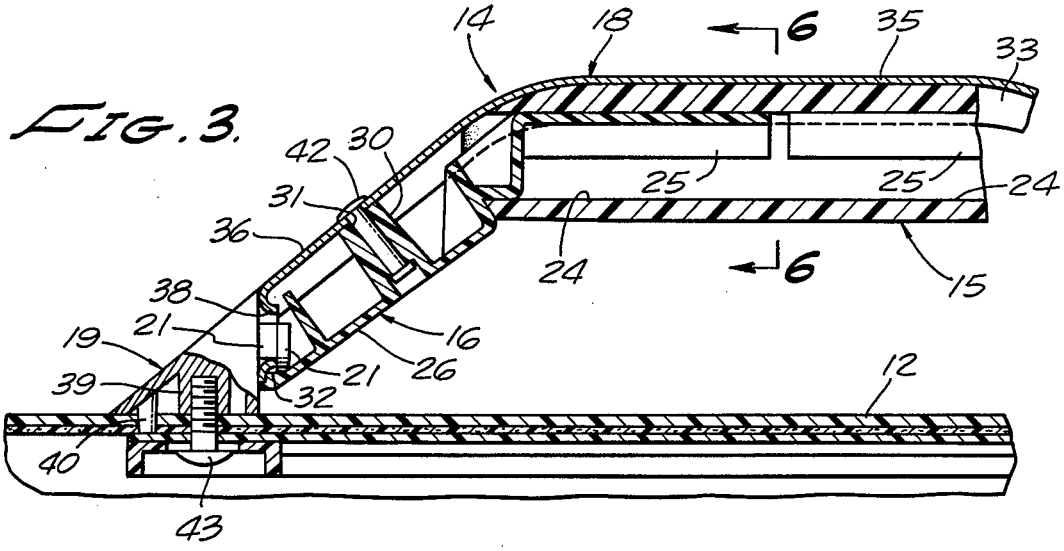
FIG. 3 is a sectional, elevational, partly fragmentary view taken along the line 3—3 of FIG. 1.
Figure 4:
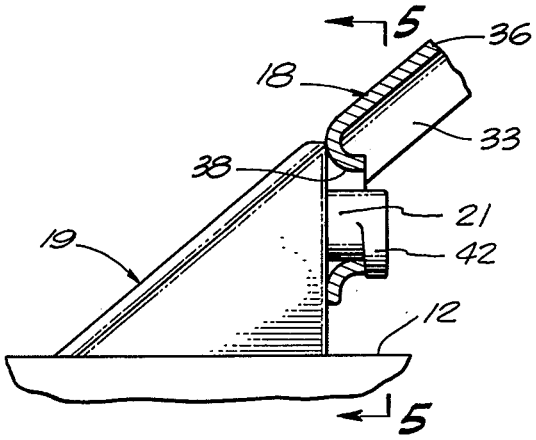
FIG. 4 is an enlarged sectional, fragmentary view of the mounting stanchion shown interconnected with the handle parts.

Since the end parts 16 and 17 are identical in construction, only member 16 will be described in detail. The handle end part includes an elongated, U-shaped channel 25 which is integrally joined with a body member 26. More particularly, the channel 25 is of cross-sectional dimensions and geometry generally the same as only slightly smaller than those of the opening 24 in the gripping member 15, thereby enabling the channel member to be fittingly received within that opening as shown in FIG. 3.

Preferably, the body member 26 extends angularly away from channel 25 (e.g., 45–90 degrees) and what is the outwardly directed surface in assembly has a pair of extended shoulders 27 and 28 formed along the body side walls, which shoulders have a mutual spacing substantially identical to that of the grooves 22 and 23. An upstanding mounting post 30 has a threaded opening 31 therein for a purpose to be described. The lowermost end of 26 is faced off at substantially 90 degrees to the channel 15 and includes a recessed shoulder 32.

Preferably, the members 16 and 17 are of molded one-piece construction. Any one of a number of hard plastic materials, such as acrylonitrile-butadiene-styrene (ABS) are suitable for this purpose. Alternatively, they may be made of metal.

The frame 18 consists of a thin metal sheet stamped into a shape including a rectangular center strip extending throughout its complete length with two side or edge walls 33 and 34. From the side, the frame is seen to have a straight line central portion 35 and two end portions 36 and 37 formed to 35 and lying in the same plane. Each outer end of the frame end portions is faced off at 90 degrees to the central portion and includes an opening therein to be more particularly described. The shape and dimensions of the frame are such that the central portion side walls 33 and 34 can be received into the grooves 22 and 23 of the gripping member with the central portion of the frame in full intimate contact with the intervening parts of the gripping member (FIG. 6). Also, these frame edge walls in the frame end portions are so dimensioned as to permit receipt on 16 and 17 with the edges resting on shoulders 27 and 28.

Figure 5:
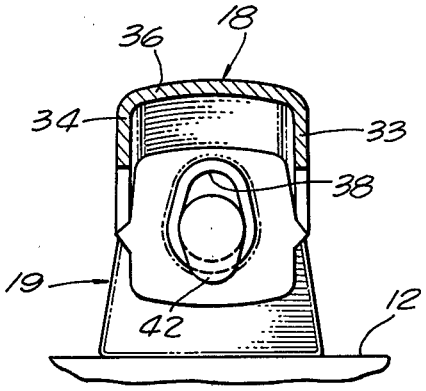
FIG. 5 is an end elevational, sectional view taken along the line 5—5 of FIG. 4.
Figure 7:
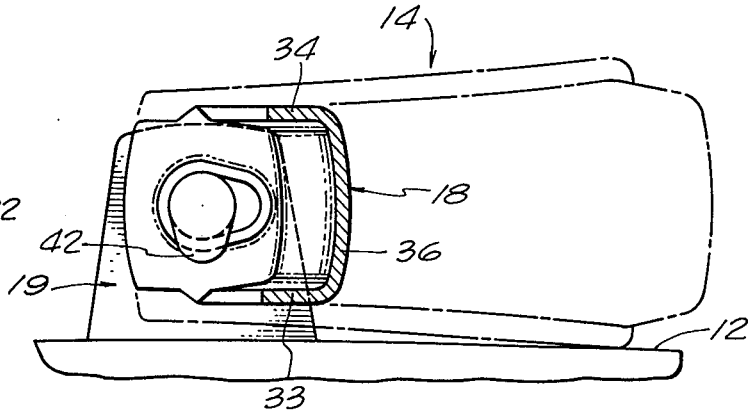
FIG. 7 is a sectional, partially schematic view showing the handle assembly arranged at 90° to that shown in FIG. 5.

As can be seen best in FIGS. 5 and 7, the opening 38 in each end of the frame 18 is oblong or egg-shaped with the narrow width being at the top and the broader width at the bottom. This shape is keyed as will be described to permit a locking engagement with parts on the stanchions 19 and 20.

The stanchions 19 and 20 are identical, therefore only 19 will be described in detail, and is seen to include in its major aspect a generally triangular body. A cylindrical post 39 extends out from one surface thereof for passing through an opening provided in the top of the case cover 12 and via which the stanchion is secured by suitable threaded member. Slightly spaced from the post 39 is a cylindrical positioning pin 40 for extending through a further opening in the cover to orient the stanchion in a fixed predetermined manner. On a flat surface at 90 degrees to that carrying the post 39 and pin 40, there is a stub shaft 41, the outer end of which is formed into an oblong head 42 of geometry identical to the opening 38 in the end of member 18.

In assembly, the U-shaped channel member 25 of each end part 16,17 is pressed into an end opening 24 of the gripping member 15. The half-shell frame 18 is then placed onto the gripping member and end parts with the frame edge walls 33 and 34 disposed within grooves 23 and 24 and resting on shoulders 27 and 28. Also, the terminal end portions of the frame are fitted into the recessed shoulders 32 of the gripping member end portions. A rivet 42, or optionally a threaded member, extends through an opening 43 in the frame for securement in the post 30. Next, the oblong head 41 of each stanchion is aligned and passed through a respective frame opening 38 and rotated to the locking position shown in FIG. 5. Finally, the post 39 is secured to the luggage cover top by threaded means 43 with the positioning key 40 also properly located within a receiving opening on the cover.

We claim:

1. A luggage case handle assembly, comprising:

a resilient gripping member having a pair of mutually spaced grooves on an outer surface and first and second openings on opposite sides thereof;

first and second end parts received in the respective first and second openings and extending angularly from said gripping member in the same plane;

a one-piece metal cover having edges received in the gripping member grooves and overlying the end parts, said cover including first and second mutually spaced openings;

means securing said metal cover to said end parts; and first and second stanchions for securement to the luggage case, each said stanchion having a stub shaft which is received in one of said cover first and second openings.

2. A luggage case handle assembly as in claim 1, in which said cover first and second openings and the terminal ends of said shafts are of such geometry that the terminal ends of said shafts may be passed through said openings for one relative position only and prevented from passing therethrough for all other relative positions.

3. A luggage case handle assembly, as in either of claims 1 or 2, in which the end parts each include a pair of recessed shoulders on which the cover edges respectively rest.

4. A luggage case handle assembly as in claim 1, in which the gripping member is molded from a pliant material.

5. A luggage case handle assembly as in claim 1, in which the metal cover portions immediately surrounding the first and second openings are formed parallel to one another and are received into further recessed shoulders in the end parts.

6. A handle assembly adapted for swiveling securement to the outer wall of a luggage case, comprising:

an elongated member constructed of a material compliant to finger pressure, which member has a passageway extending longitudinally therethrough and terminating at opposite ends of the member in first and second openings respectively, and first and second longitudinal grooves on an outer surface of said member;

first and second end parts received in the respective first and second openings of the elongated member and extending outwardly from said member at the same angle and lying in the same plane, said end parts having a pair of recessed shoulders;

an elongated metal cover of generally U-shaped cross-section the side edges of which are received within the respective member grooves and end points recessed shoulders, said cover having its two end portions formed into parallel relation with each of said end portions including an opening therethrough;

means affixing said metal cover to said first and second end parts; and first and second stanchions for securement to the outer wall surface of the luggage case, each stanchion having a stub shaft received within one of the cover end portion openings, the geometry of the stub shaft terminal ends and cover end portions being such that the shaft terminal ends can only pass through said openings for one relative angular orientation and obstructed from passage therethrough for all other angular orientations.

* * * * *